US012092373B2

(12) United States Patent
Dorin et al.

(10) Patent No.: US 12,092,373 B2
(45) Date of Patent: Sep. 17, 2024

(54) RECIPROCATING-TYPE COMPRESSOR FOR REFRIGERATION AND/OR CONDITIONING AND/OR HEAT PUMP SYSTEM

(71) Applicant: OFFICINE MARIO DORIN S.P.A., Fiesole (IT)

(72) Inventors: Mario Dorin, Fiesole (IT); Mauro Dallai, Fiesole (IT)

(73) Assignee: OFFICINE MARIO DORIN S.P.A., Fiesole (IT)

( * ) Notice: Subject to any disclaimer, the term of this patent is extended or adjusted under 35 U.S.C. 154(b) by 699 days.

(21) Appl. No.: 17/284,353

(22) PCT Filed: Oct. 11, 2019

(86) PCT No.: PCT/IB2019/058685
§ 371 (c)(1),
(2) Date: Apr. 9, 2021

(87) PCT Pub. No.: WO2020/075128
PCT Pub. Date: Apr. 16, 2020

(65) Prior Publication Data

US 2021/0356175 A1 Nov. 18, 2021

(30) Foreign Application Priority Data

Oct. 12, 2018 (IT) ..... 102018000009418

(51) Int. Cl.
*F25B 1/02* (2006.01)
*F04B 27/04* (2006.01)
(Continued)

(52) U.S. Cl.
CPC ..... *F25B 1/02* (2013.01); *F04B 27/0839* (2013.01); *F04B 39/0055* (2013.01);
(Continued)

(58) Field of Classification Search
CPC ..... F25B 1/02; F25B 2400/074; F25B 2400/075; F04B 27/0839; F04B 39/0055;
(Continued)

(56) References Cited

U.S. PATENT DOCUMENTS 1,916,130 A * 6/1933 Torrey ..... F25B 31/00 417/571
2,150,487 A * 3/1939 Brown ..... F04B 39/0016 62/468
(Continued)

FOREIGN PATENT DOCUMENTS

EP 1431580 A1 6/2004
WO WO-9953200 A1 * 10/1999 ..... F04B 39/0055

*Primary Examiner* — Charles G Freay
*Assistant Examiner* — David N Brandt
(74) *Attorney, Agent, or Firm* — McGlew and Tuttle, P.C.

(57) ABSTRACT

Reciprocating-type compressor for refrigeration and/or conditioning and/or heat pump systems, comprising—a casing in which there is defined at least one compression section comprising at least one cylinder and a corresponding compression piston, —a head provided on said casing, defining a delivery chamber immediately down-stream of said compression section, and adapted to receive the compressed fluid from said compression section, —an intake zone from where the fluid to be compressed in the at least one cylinder of said compression section is introduced, —a delivery tap at the operational outlet of said compression chamber, characterized in that it comprises a check valve placed between said operational outlet of said compression chamber and said delivery tap, adapted to prevent the return of fluid into the compression chamber from said delivery tap.

16 Claims, 3 Drawing Sheets

(51) Int. Cl.

| | |
|---|---|
| ***F04B 27/08*** | (2006.01) |
| ***F04B 39/00*** | (2006.01) |
| ***F04B 39/10*** | (2006.01) |
| ***F04B 39/12*** | (2006.01) |
| ***F04B 53/10*** | (2006.01) |

(52) U.S. Cl.
CPC ..... *F04B 39/1066* (2013.01); *F04B 39/1073* (2013.01); *F04B 39/121* (2013.01); *F04B 27/0451* (2013.01); *F04B 39/1026* (2013.01); *F04B 39/125* (2013.01); *F04B 53/1035* (2013.01); *F04B 53/104* (2013.01); *F25B 2400/074* (2013.01); *F25B 2400/075* (2013.01)

(58) Field of Classification Search
CPC ..... F04B 39/1066; F04B 39/1073; F04B 39/121; F04B 27/04; F04B 27/0451; F04B 27/0465; F04B 39/102; F04B 39/1026; F04B 39/125; F04B 53/1035; F04B 53/104
See application file for complete search history.

(56) References Cited

U.S. PATENT DOCUMENTS

| | | | | |
|---|---|---|---|---|
| 4,179,248 | A | 12/1979 | Shaw | |
| 4,741,674 | A | 5/1988 | Tischer | |
| 2011/0005266 | A1* | 1/2011 | Martin | F04B 39/0238 62/468 |
| 2012/0027633 | A1* | 2/2012 | Dugast | F04B 39/123 417/522 |
| 2018/0112653 | A1* | 4/2018 | Dent | F04B 53/006 |

* cited by examiner

RECIPROCATING-TYPE COMPRESSOR FOR REFRIGERATION AND/OR CONDITIONING AND/OR HEAT PUMP SYSTEM

TECHNICAL FIELD

The present invention relates to the sector of compressors, and more particularly relates to a reciprocating-type compressor for refrigeration and/or conditioning and/or heat pump systems.

An object of the invention is also a refrigeration and/or conditioning and/or heat pump system, or a portion thereof, using a plurality of compressors in parallel.

STATE OF THE ART

As is known, in refrigeration and/or conditioning and/or heat pump systems there is often the need to fit several compressors in parallel. In such a case, the delivery conduits of the compressors are connected to one another, in other words they are common with one another and all have the same pressure.

Often, in these systems it may happen that some compressors are in operation while others are not. The situation with one or more compressors in operation and one or more compressors not in operation is very frequent. Since the delivery conduits are common to several compressors, even the non-operating compressors have their delivery conduit pressurized, the same as the operating compressors. The delivery valves of the compressor cylinders are not perfectly water-tight, meaning that in the non-operating compressors there is recirculation between delivery and intake. This recirculation negatively influences the efficiency of the entire refrigeration cycle. In multi-cylinder, high-pressure compressors, characterized by a large number of valves and high differential pressure between delivery and intake, the impact of the recirculation can become significant.

OBJECT AND SUMMARY OF THE INVENTION

The object of the present invention is to eliminate or reduce the recirculation of fluid between delivery and intake in compressors fitted in parallel in refrigeration and/or conditioning and/or heat pump systems, when they are not operating.

This and other objects, which will become more evident later, are achieved with a reciprocating-type compressor structure for refrigeration and/or conditioning and/or heat pump systems, comprising

- a casing in which there is defined at least one compression section comprising at least one cylinder and a corresponding compression piston,
- a head provided on said casing, defining a delivery chamber immediately down-stream of said compression section, and adapted to receive the compressed fluid from said compression section,
- an intake zone from where the fluid to be compressed in the at least one cylinder of said compression section is introduced,
- a delivery tap at the operational outlet of said compression chamber;

the peculiar feature of the compressor structure lies in the fact that it comprises a check valve placed between the operational outlet of the compression chamber and the delivery tap, adapted to prevent the return of fluid into the compression chamber from the delivery tap, thereby limiting or preventing the recirculation of fluid between the delivery and intake conduits of the compressor, in the case of a non-operating compressor inserted in a system of compressors in parallel, at least some of which are in operation.

It is clear that the check valve is inside the compressor structure.

Preferably, the check valve is a swing check valve.

More preferably, the swing check valve is a gravity-closing type.

In preferred embodiments, the swing check valve comprises a closing flap hinged at the side to the passage to be closed (the operational outlet of the compression chamber); the flap rises with the passage of a flow from the compression chamber towards the delivery tap and closes against the passage due to gravity when the flow stops.

Advantageously, the check valve may be housed in a compartment comprising a floor wherein there is the passage to be closed towards the compression chamber, and a ceiling against which preferably said flap moves to the open position, with a position inclined with respect to the axis of opening, with the closing face of the flap turned towards the passage to be closed.

Preferably, this inclined position is between 15° and 75° with respect to the axis of the passage between the delivery chamber and tap.

Preferably, this compartment is defined at least in part on the head.

Preferably, the floor of the compartment and at least part of the walls of the compartment are defined in the head.

Preferably, the ceiling is defined in the body of the tap.

Preferably, the delivery tap is fixed to the head, in a water-tight manner, by means of threaded elements.

A system conduit in which the compressor is inserted leaves the tap; in practice, the conduit is not part of the compressor, while the check valve is inside the compressor.

According to preferred embodiments, the check valve comprises a collar wherein there is defined a hole for the passage of fluid; the closing flap is hinged to this collar. On the head there is a housing recess for the collar; preferably the collar has at least one threaded element for fixing to the head.

In other embodiments, the check valve may be created entirely on the head (in which case the floor, walls and ceiling of the flap housing compartment are created entirely on the head), or else entirely on the delivery tap (in which case the floor, walls and ceiling of the flap housing compartment are created entirely tap body).

According to preferred embodiments, the head is fixed to the casing, in a water-tight manner, preferably by means of threaded elements.

According to preferred embodiments, at least one compression section comprises an intake and delivery valve-holder body placed between the relative head and the casing.

According to preferred embodiments, the structure is for a multi-cylinder compressor. This compressor structure may comprise several compression sections, and each section may comprise one or more compression cylinders and relative pistons. For example, the compression sections may be arranged in parallel along the control axis of rotation of the crank gear driving the compressor pistons (i.e. with pistons that translate in parallel between one another), or they may be angularly offset from one another around this axis of rotation, or even a combination of these two possibilities.

Therefore, preferably, the head comprises a common delivery chamber for all the compression sections, into which the fluid compressed by the cylinders of the compression sections is sent.

Preferably, the head comprises, as an intake zone, several intake chambers for the intake sections, or a common intake chamber for all the compression sections, from which the fluid is introduced into the cylinders of the compression sections, or several intake chambers.

According to another aspect, the invention relates to a compressor assembly with a structure according to one or more of the previous embodiments, wherein the compressors have their respective delivery taps connected to one another in parallel, in other words they are connected, by means of conduits external to the compressors, to a common delivery conduit, i.e. they have the same delivery pressure, and wherein, during use, one or more of the compressors may be non-operational while the others are operational.

According to a further aspect, the invention relates to a refrigeration and/or conditioning and/or heat pump system, comprising a plurality of compressors with a structure according to one or more of the previous embodiments, arranged in parallel, in other words they are connected to a common delivery conduit, i.e. the compressors have at least their respective delivery taps connected to one another in parallel.

According to yet another aspect, the invention relates to a method of installation of a refrigeration and/or conditioning and/or heat pump system, comprising the step of connecting in parallel to one another, to a system branch, a plurality of compressors with a structure according to one or more of the previous embodiments, wherein the compressors have their respective delivery taps connected to one another in parallel, in other words they are connected to a common delivery conduit, i.e. they have the same delivery pressure, and preferably at least some of them have a common intake branch.

BRIEF DESCRIPTION OF THE DRAWINGS

Further characteristics and advantages of the invention will become more apparent from the following description of a preferred but non-exclusive embodiment thereof, illustrated by way of non-limiting example in the accompanying drawings, wherein.

DETAILED DESCRIPTION OF AN EMBODIMENT OF THE INVENTION

Figure 1:
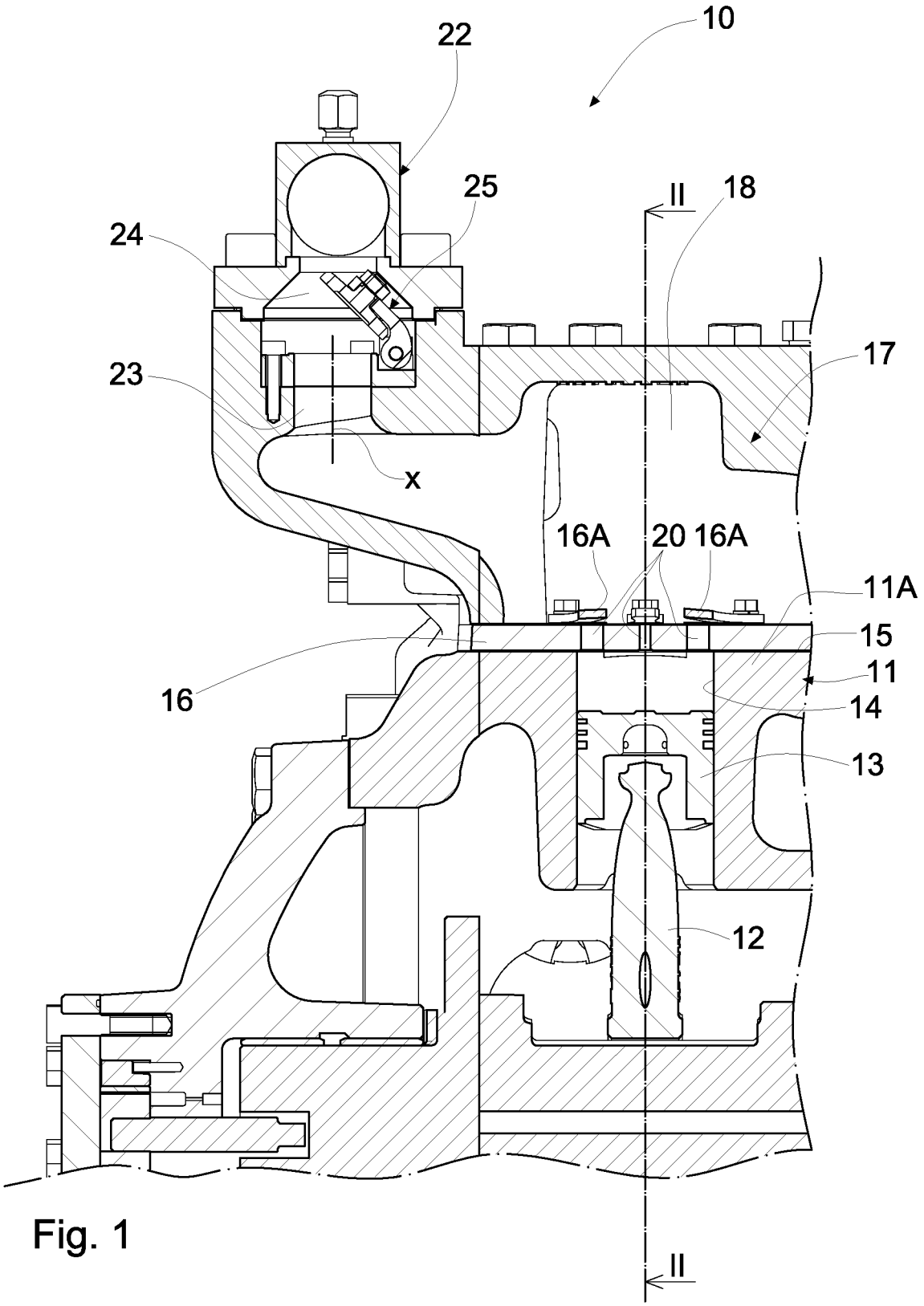
FIG. 1 shows a cross section, at least partly along the line II-II shown in FIG. 2, of an upper portion and end portion of a compressor with a structure according to the invention.
Figure 2:
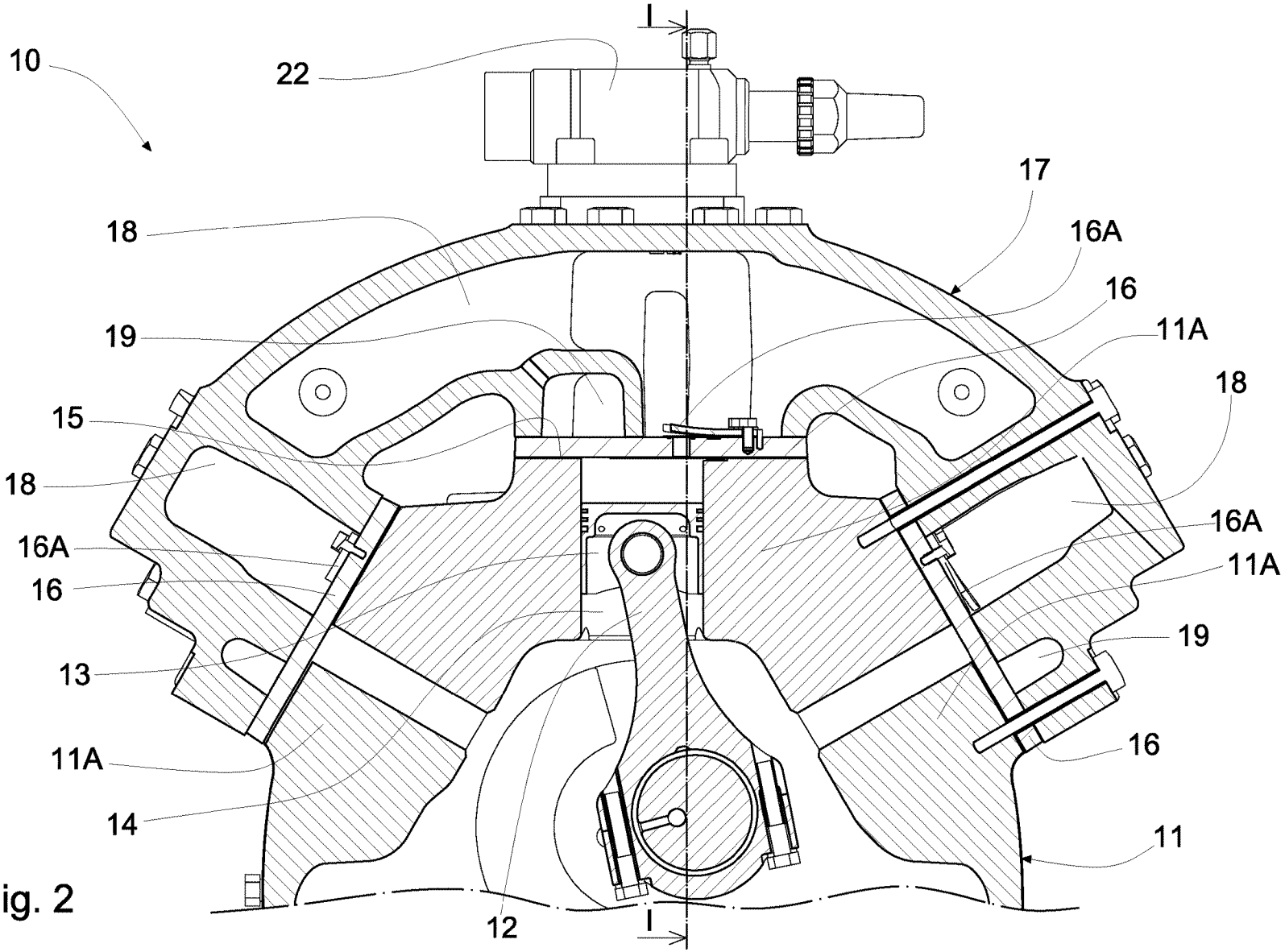
FIG. 2 shows a cross section, at least partly along the line I-I shown in FIG. 1, of the upper portion of the compressor shown in FIG. 1.
Figure 3:
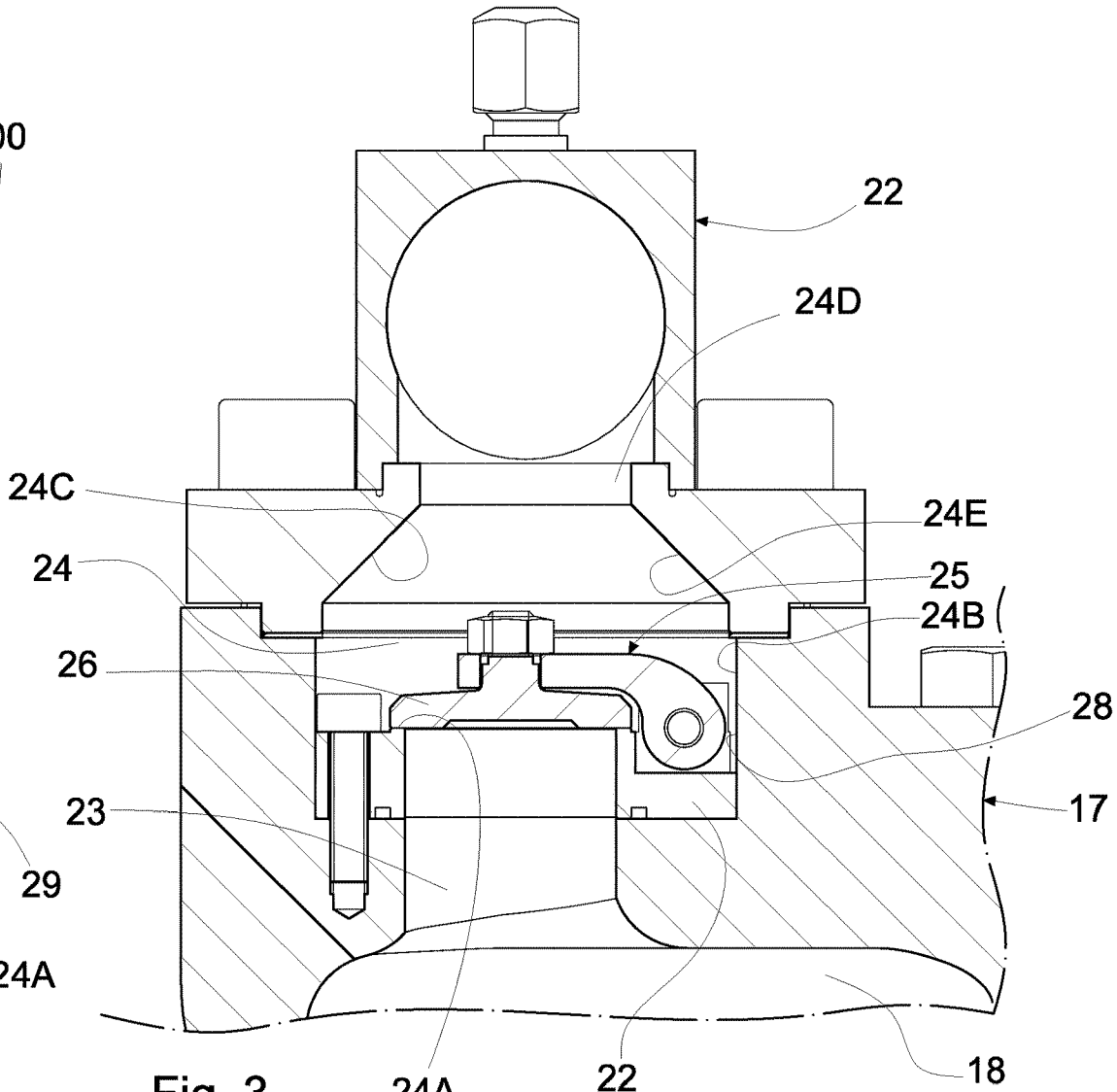
FIG. 3 shows an enlargement of FIG. 1, showing the area of the check valve at the outlet from the compressor delivery chamber, wherein the valve is closed.
Figure 5:
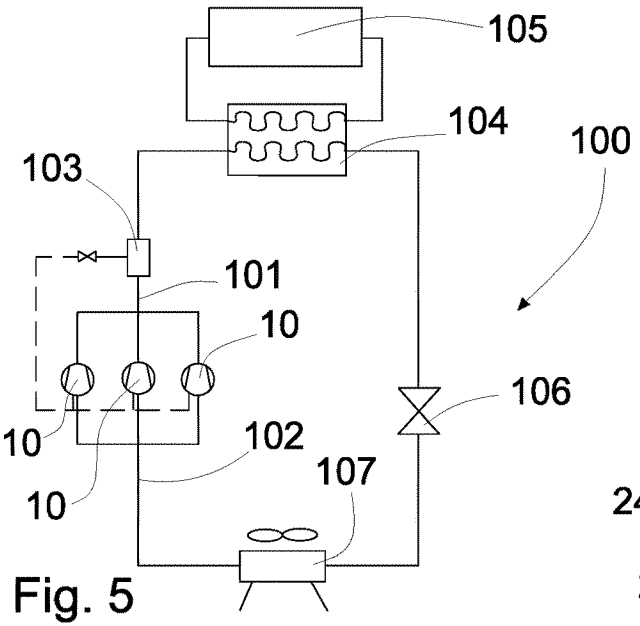
FIG. 5 shows a generic layout of a conditioning system, using a plurality of compressors as shown in the previous figures, mounted in parallel; each compressor is connected to a delivery conduit, external to the compressor structure, in other words not part of the compressor.
Figure 4:
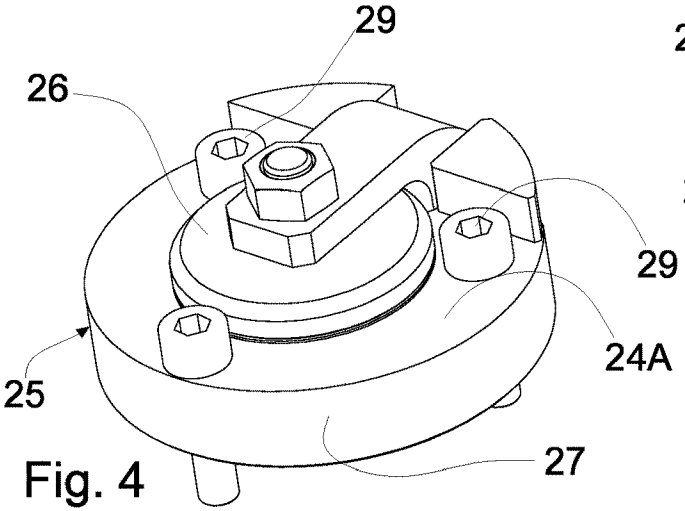
FIG. 4 shows an axonometric view of a check valve used in the compressor shown in the previous figures.

With reference to the aforesaid figures, a compressor with a structure according to the present invention is indicated as a whole with the number 10. A conditioning system (for example for heating the domestic water supply, heating or cooling the environment) using a plurality of compressors 10 arranged in parallel is indicated as a whole with the number 100. In FIG. 5, the system shows the compressors 10 in parallel, to which are associated outlet conduits that connect in a common delivery conduit 101, and a common intake conduit 102. Compressor outlet conduits, delivery and intake conduits are external to the compressor structures, in other words they are part of the system but not of the compressors. The system, as is well known, schematically consists of an oil separator 103, a condensing unit 104 for heat exchange with the utilities 105, an expander 106 and an evaporator 107.

Each compressor 10 is, for example, a multi-cylinder compressor and comprises a casing 11 in which there is housed a motor, for example an electric motor (not shown in the figures) to which is associated an output shaft on which are mounted the connecting rods 12 (only one of which is visible in the figures) carrying at the end pistons 13 (only one of which is visible in the figures) arranged in corresponding cylindrical sleeves 14 (or cylinders, for short) created on the periphery of the casing 11 (i.e. on the upper part, with reference to the figures). Connecting rods, pistons, cylinders and valves make up the intake/compression members. Each combination of connecting rod, cylinder and piston defines a compression section of the compressor. Lubricant oil is contained inside the casing 11 in which the shaft and connecting rods 12 turn.

In this example, the casing 11 has three casing portions 11A, angularly offset from one another by 60° with respect to the axis of the compressor motor, and on each of which there are defined one or more compression sections (in the figures only one compression section, the central one, is fully visible)

Each compression section also comprises intake and delivery valves. In particular, the cylinders 14 are open on respective upper surfaces 15, on which are placed intake and delivery valve-holder plates 16, which close the cylinders. On each plate 16 there are holes, appropriately closed by the delivery and intake valves, of a known type. The figures show only the passages relating to the delivery valves, with which the delivery valves, which are small and not very visible, are associated. Delivery passages and relative delivery valves are indicated by the number 20. The number 16A is used to indicate the limit stops.

Positioned on the plates 16 is the compressor head 17, defining a single delivery chamber 18, into which the refrigeration fluid compressed in the cylinder is sent, and intake chambers 19 from which the refrigeration fluid is taken into the cylinder 14.

In particular, in this example, there is a single head 17 connected in a water-tight manner, by means of threaded elements, to the plates 16 and to the portions 11A of the casing 11, and which defines a single delivery chamber 18, on which all the compressor cylinders open (by means of the relative delivery valves 16A), and the intake chambers 19, on which the respective cylinders open by means of the relative intake valves.

On the head 17 there is a delivery tap 22, which allows connection of the compressor 10 to the delivery conduit 101 common to all the other compressors 10 in the system 100. The delivery tap is fixed to the head 17, in a water-tight manner, by means of threaded elements. In practice, the conduit connected to the delivery tap is external to the compressor, in other words it is not part of it.

In particular, at the delivery tap 22, the head 17 comprises an operational outlet in the form of a passage 23 connecting the delivery chamber 18 to a compartment 24 in which there is a check valve 25, adapted to prevent fluid returning to the compression chamber from the tap in the event that the compressor is not in operation and one or more of the other compressors 10 is in operation. The tap 22 enables controlled communication between the compartment 24 and the delivery conduit 101.

It is clear that the check valve is inside the compressor structure.

In particular, the check valve 25 is a swing check valve and comprises a closing flap 26 hinged at the side to the passage 23. The flap 26 lifts with the passage of a flow from the delivery chamber 18 towards the delivery tap 22 and re-closes against the passage 23 due to gravity when the flow stops. The lower face of the flap 26, which is preferably made of metallic material, is characterized by a surface finish with very low degree of roughness, in practice a surface with a polished mirror surface, and has a high degree of hardness. The horizontal surface on which the flap rests when it is closed is also preferably made of metallic material, and has a similar surface finish with low degree of roughness and a high degree of hardness, thereby guaranteeing an excellent seal.

In the example described, the check valve 25 comprises a collar 27 in which there is a hole defining the passage 23 for the fluid.

The closing flap 26 is hinged to this collar 27. On the head 17 there is a housing recess 28 for the collar 27, which is fixed to the head by threaded elements 29.

The compartment 24 in which the closing flap 26 is housed comprises a floor 24A defined by the upper surface of the collar 27, walls 24B defined mainly by the housing recess 28 on the head 17, and a ceiling 24C created by the body of the delivery tap. On the ceiling 24C there is a hole 24D connecting the compartment 24 with the outlet of the tap 22 towards the conduit 101.

The ceiling 24C is shaped so as to form a rotational limit stop 24E for the flap 26 when in the lifted, or open, position. In practice, when the flap is at the maximum open position, it meets the limit stop 24E thereby defining its inclined position with respect to the X-axis of the hole 23 (with the closing face of the flap turned towards the hole 23). Preferably, this inclined position is between 15° and 75° with respect to the X-axis. Furthermore, in the inclined raised position, the flap partially obstructs the hole 24D.

In practice, according to the description, in the compressor according to the invention, a swing check valve has been installed at the outlet of the delivery chamber in order to reduce drastically recirculation between intake and delivery.

The valve is characterized by a flap which is lifted by the flow of compressed refrigerating fluid.

The lower face of the flap is characterized by a mirror-finish surface and a high degree of hardness. The horizontal surface on which the flap rests also has an excellent surface finish and a high degree of hardness. The tap is shaped on the inside to accommodate the movement of the flap and to halt its lifting in an oblique position so as to limit turbulence and drops in pressure.

The absence of elastic elements in the check valve makes the device very stable.

In the event that the compressor stops, gravity causes the flap to close until it comes into contact with the sealing face.

The surface characteristics of the contact faces of the flap/delivery chamber passage, combined with the high pressure upstream and downstream of the valve, considerably limits the amount of recirculation with a consequent positive impact on system efficiency.

It is understood that the drawings only show possible non-limiting embodiments of the invention, which can vary in forms and arrangements without however departing from the scope of the concept on which the invention is based. Any reference numerals in the appended claims are provided purely to facilitate the reading thereof, in the light of the above description and accompanying drawings, and do not in any way limit the scope of protection.

The invention claimed is:

1. A compressor structure for refrigeration and/or conditioning and/or heat pump systems, the compressor structure comprising;

a casing in which there is defined at least one compression section, each compression section comprising at least one cylinder and a corresponding compression piston, a head provided on said casing, defining a delivery chamber immediately downstream of said at least one compression section, and adapted to receive a compressed fluid from said at least one compression section, an intake zone from where a fluid to be compressed in the at least one cylinder of said at least one compression section is introduced, a delivery tap at an operational outlet of said delivery chamber, and a check valve, placed between said operational outlet of said delivery chamber and said delivery tap, adapted to prevent the return of fluid into the delivery chamber from said delivery tap, wherein said check valve is a gravity-closing swing check valve.

2. The compressor structure according to claim 1, wherein said swing check valve comprises a closing flap hinged at a side of the operational outlet; said closing flap lifting with a flow from said delivery chamber towards said delivery tap and closing against the operational outlet due to gravity when the flow stops.

3. The compressor structure according to claim 2, wherein said check valve comprises a collar wherein there is defined a hole for the passage of fluid, to which said closing flap is hinged, there being present in said head a housing recess for said collar; said collar having at least one threaded element for fixing to said head.

4. The compressor structure according to claim 1, wherein said check valve is housed in a compartment comprising a floor, wherein the operational outlet is within the floor, and a ceiling against which a flap contacts in an open position, a closing face of the flap is inclined with respect to an axis of the operational outlet, the closing face of the flap is inclined between 15° and 75° in the open position.

5. The compressor structure according to claim 4, wherein said compartment is defined at least in part by said head; the floor of said compartment and at least part of walls of the compartment are defined in said head.

6. The compressor structure according to claim 5, wherein said delivery tap is fixed to said head in a water-tight manner, by means of threaded elements, said ceiling being defined in a body of said delivery tap.

7. The compressor structure according to claim 1, wherein said head is fixed in a water-tight manner, by means of threaded elements, to said casing.

8. The compressor structure according to claim 1, wherein each compression section of the at least one compression section comprises an intake and delivery valve-holder body placed between the head and said casing.

9. The compressor structure according to claim 1, wherein the at least one compression section is comprised of several compression sections, each of the several compression sections angularly offset from one another around a control axis of rotation of a crank gear driving each of the corresponding compression pistons.

10. The compressor structure according to claim 9, wherein the delivery chamber of said head is a common delivery chamber for all the several compression sections, into which fluid compressed in the cylinders of the several compression sections is sent.

11. The compressor structure according to claim 9, wherein the intake zone of said head comprises one or more intake chambers for the several compression sections, from which the fluid to be compressed is introduced into each cylinder of the several compression sections.

12. A compressor assembly comprising a plurality of the compressor structures according to claim 1, wherein the respective delivery taps of each of the plurality of compressor structures are connected to one another in parallel, wherein each of said plurality of compressor structures are connected to a common delivery conduit, and have the same delivery pressure, and wherein one or more of said plurality of compressor structures may be non-operational while the others are operational.

13. A refrigeration and/or conditioning and/or heat pump system, comprising a plurality of compressors, wherein each of the plurality of compressors are comprised of the compressor structure according to claim 1, each of the plurality of compressors arranged in parallel, wherein each of the plurality of compressors are connected to a common delivery conduit, each delivery tap of each compressor of the plurality of compressors are connected to one another in parallel.

14. A method of installation of a refrigeration and/or conditioning and/or heat pump system, the method comprising: providing a plurality of compressors, each of the plurality of compressors comprising a compressor structure for the refrigeration and/or the conditioning and/or the heat pump systems, the compressor structure comprising: a casing in which there is defined at least one compression section, each compression section comprising at least one cylinder and a corresponding compression piston; a head provided on said casing, defining a delivery chamber immediately downstream of said at least one compression section, and adapted to receive a compressed fluid from said at least one compression section; an intake zone from where a fluid to be compressed in the at least one cylinder of said at least one compression section is introduced; a delivery tap at an operational outlet of said delivery chamber; and a check valve, placed between said operational outlet of said delivery chamber and said delivery tap, adapted to prevent the return of fluid into the delivery chamber from said delivery tap, wherein said check valve is a gravity-closing swing check valve; and connecting each of the plurality of compressors in parallel to one another, to a system branch, wherein the respective delivery taps of each of the plurality of compressors are connected to one another in parallel, wherein each of said plurality of compressors are connected to a common delivery conduit, wherein each of said plurality of compressors have the same delivery pressure, and at least some of said plurality of compressors have a common intake branch.

15. A compressor structure for refrigeration and/or conditioning and/or heat pump systems, the compressor structure comprising:

a casing in which there is defined at least one compression section, each compression section comprising at least one cylinder and a corresponding compression piston, a head provided on said casing, defining a delivery chamber immediately downstream of said at least one compression section, and adapted to receive a compressed fluid from said at least one compression section, an intake zone from where a fluid to be compressed in the at least one cylinder of said at least one compression section is introduced, a delivery tap at an operational outlet of said delivery chamber, and a check valve, placed between said operational outlet of said delivery chamber and said delivery tap, adapted to prevent the return of fluid into the delivery chamber from said delivery tap, wherein said check valve is a swing check valve, wherein said swing check valve comprises a closing flap hinged at a side of the operational outlet, said closing flap lifting with a flow from said delivery chamber towards said delivery tap and closing against the operational outlet due to gravity when the flow stops.

16. A compressor structure for refrigeration and/or conditioning and/or heat pump systems, the compressor structure comprising:

a casing in which there is defined at least one compression section, each compression section comprising at least one cylinder and a corresponding compression piston, a head provided on said casing, defining a delivery chamber immediately downstream of said at least one compression section, and adapted to receive a compressed fluid from said at least one compression section, an intake zone from where a fluid to be compressed in the at least one cylinder of said at least one compression section is introduced, a delivery tap at an operational outlet of said delivery chamber, and a check valve, placed between said operational outlet of said delivery chamber and said delivery tap, adapted to prevent the return of fluid into the delivery chamber from said delivery tap, wherein said check valve is housed in a compartment comprising a floor, wherein the operational outlet is within the floor, and a ceiling against which said flap contacts in an open position, a closing face of the flap is inclined with respect to an axis of the operational outlet.

* * * * *